US005244768A

United States Patent [19]

Inaba

[11] Patent Number: 5,244,768

[45] Date of Patent: Sep. 14, 1993

[54] MANUFACTURING PROCESS FOR AN ELECTROPHOTOGRAPHIC TONER

[75] Inventor: Yoshihiro Inaba, Minami-ashigara, Japan

[73] Assignee: Fuji Xerox Co., Ltd., Tokyo, Japan

[21] Appl. No.: 835,894

[22] Filed: Feb. 14, 1992

[30] Foreign Application Priority Data

Feb. 15, 1991 [JP] Japan ..... 3-022039
Jun. 12, 1991 [JP] Japan ..... 3-167832

[51] Int. Cl.[5] ..... G03G 9/083
[52] U.S. Cl. ..... 430/137; 430/106.6
[58] Field of Search ..... 430/138, 137

[56] References Cited

U.S. PATENT DOCUMENTS 3,016,308 1/1962 Macaulay ..... 430/138
3,338,991 8/1967 Insalaco et al. ..... 430/137
3,893,933 7/1975 Brown ..... 430/137

FOREIGN PATENT DOCUMENTS 57-045558 3/1982 Japan .
57-179860 11/1982 Japan .
57-202547 12/1982 Japan .
58-066948 4/1983 Japan .
58-145964 8/1983 Japan .
59-148066 8/1984 Japan .
59-162562 9/1984 Japan .
60-173552 9/1985 Japan .
62-227161 10/1987 Japan .
62-227162 10/1987 Japan .
63-027853 2/1988 Japan .
63-027854 2/1988 Japan .
63-049766 3/1988 Japan .
63-163373 7/1988 Japan .

*Primary Examiner*—John Goodrow
*Attorney, Agent, or Firm*—Finnegan, Henderson, Farabow, Garrett & Dunner

[57] ABSTRACT

A process for manufacturing an electrophotographic toner is disclosed, comprising preparing a toner dispersion, adding a monomer and polymerizing without an emulsifier or with an emulsifier concentration less than the critical micell concentration. The toner has triboelectrification controlling properties on its surface, not influenced by the triboelectrification properties of coloring material when used in the toner, and without adhesive coagulation of the toner particles. It has excellent triboelectrification stability against environmental change and produces a good image free of fog.

20 Claims, No Drawings

MANUFACTURING PROCESS FOR AN ELECTROPHOTOGRAPHIC TONER

FIELD OF THE INVENTION

The present invention relates to a process for manufacturing electrophotographic toners.

BACKGROUND OF THE INVENTION

Conventionally, in manufacturing electrophotographic toners, a charge controlling agent is dispersed in a toner binder to control triboelectrification properties, i.e., a controlling agent is incorporated in a toner binder with coloring material and other additives followed by kneading and pulverizing to make the toner.

In this process, however, the triboelectrification property is not stable since it depends on the degree of dispersion of the charge controlling agent, and since the triboelectrification property depends on the charge controlling agent on the toner surface, any charge controlling agent inside of the toner does not influence triboelectrification. Additionally, the foregoing prior art process causes a loss of fixing performance as well as the mechanical strength of the binder resin. What is worse, since the charge controlling agent is in a state where it is mixed with coloring material, it is influenced by the triboelectrification property of the coloring material. Therefore, in manufacturing different colored toners, the type and quantity of charge controlling agent must be changed depending on the coloring material and results in high manufacturing costs. Additionally, this process can not be applied to a capsule toner having a core/shell structure.

Another toner manufacturing process is described in Japanese unexamined patent publication Nos. Sho 57-202547, 63-27853 and 63-27854 which disclose a process for manufacturing a toner by spray drying a polymer, which contains a charge controlling agent onto toner particles or coating this polymer combination on toner particles under conditions of heat and pressure.

The spray drying process, however, has the disadvantage in that the coating layer covers a plurality of toner particles simultaneously and enlarges the toner particle diameter. Even if the toners are screened afterwards, the yield of toner with a specified particle diameter is low. Additionally, there are problems with regard to safety and sanitation when using large quantities of organic solvent which may be required in the spray drying process.

The heat fixing coating process also has the disadvantage that it brings about adhesive coagulation of toner particles, which enlarges the toner particle diameter.

As for the process for fixing coating polymers to the toner particles by the process of employing pressure, there is a disadvantage in that when this process is applied to a capsule toner having a liquid core, the capsule is destroyed. There is no problem, however, if the pressure process is applied to toners having a hard core particle.

In Japanese unexamined patent publication No. Sho 60-173552, a toner manufacturing process is disclosed in which a toner is obtained by forming a coating layer consisting of a colorant and binder resin, magnetic particle and binder resin or conductive agent and binder resin on a toner core particle surface by means of a jet mill. In Japanese unexamined patent publication No. Sho 63-49766, a process is disclosed by which a toner particle surface is coated with thermoplastic resin by a distortion mixing process. Both of these processes, as is the case with the other prior art processes described above, have the disadvantage that the capsule structure of a capsule type toner having a liquid core which is employed in pressure fixing operations, is destroyed, although they are applicable in manufacturing hard toner core particles that are employed in heat fixing operations.

A toner manufacturing process is described in Japanese unexamined patent publication No. Sho 57-45558 in which the toner is obtained by dispersing toner core particles formed by polymerization in an aqueous latex solution followed by forming a coating layer on the particle by adding a water soluble inorganic salt and precipitating microparticles on the toner core particle. This process, however, has the disadvantage that triboelectrification depends on environmental changes to a large extent, influenced by interfacial active agents or inorganic salts remaining on the microparticles. Triboelectrification declines with particles manufactured in this way, especially in an environment of high temperature and high humidity and this process also has the disadvantage that the adhesive properties between toner core particles and polymer microparticles is poor.

A process for adhering a polymer of a monomer having triboelectrification properties to a toner particle is described in Japanese unexamined patent publication Nos. Sho 62-227161 and 62-227162. These references describe the way in which a polymeric monomer having a charge controlling moiety is graft polymerized after being chemically bonded to a toner particle surface. A typical connected molecule in this regard is ethylene glycol dimethacrylate. As the charge controlling moiety is localized on the toner surface, the fixing property of the toner binder is not lost and the toner binder is not easily influenced by the triboelectrification property of coloring materials. This process, however, has the disadvantage in that the toner binder undergoes this reaction in two steps which takes time and requires additional labor which consequently leads to higher costs.

Accordingly, it is an object of the present invention to overcome these and other difficulties encountered in the prior art.

It is a further object of the present invention to provide a process for manufacturing an electrophotographic toner in which the aforesaid disadvantages are overcome without losing the fixing performance and mechanical strength of the binder resins employed in manufacturing such toners.

It is a further object of the present invention to provide a process for manufacturing an electrophotographic toner in which the toner is not influenced by the triboelectrification property of the coloring material.

It is also an object of the present invention to provide a process for manufacturing an electrophotographic toner in which the adhesive coagulation of the toner particles is eliminated or substantially minimized so that the particle diameter of the resultant toner does not increase or it substantially controlled.

It is a further object to the present invention to provide a process for manufacturing an electrophotographic toner in which the toner has excellent adhesive properties with regard to the core particle and is free or substantially free of chemically reactive groups and further can be manufactured by a relatively uncomplicated process.

It is a further object of the present invention to provide a process for manufacturing an electrophotographic toner which is applicable to capsule type toners having a liquid core wherein the resultant toner has good stability against environmental change in a triboelectrification process.

These and other objects have been achieved according to the present invention.

Additional objects and advantages of the invention will be set forth in part in the description which follows and in part will be apparent to a person with ordinary skill in the art from the description, or may be learned by practice of the invention. The objects and advantages of the invention may be realized and attained by means of the instrumentalities and combinations particularly pointed out in the appended claims.

SUMMARY OF THE INVENTION

The present invention relates to a process for manufacturing an electrophotographic toner comprising the steps of preparing a toner dispersion, adding a polymeric monomer thereto to obtain a mixture and polymerizing the mixture either without an emulisifier or with an emulsifier in an amount such that the concentration of the emulsifier is less than the critical micell concentration.

The invention also relates to such a process for manufacturing an electrophotographic toner employing a redox water soluble polymerization initiator.

DETAILED DESCRIPTION OF THE INVENTION

A process for manufacturing an electrophotographic toner has been discovered according to the present invention which comprises the steps of:

preparing a dispersion containing water and toner particles dispersed therein;

adding a polymeric monomer to the toner particles dispersed in water to obtain a mixture; and polymerizing this mixture either without an emulsifier or with an emulsifier wherein the emulsifier is present in a concentration less than the critical micell concentration.

In another embodiment, this process for manufacturing an electrophotographic toner comprises conducting the polymerization reaction in the presence of a water soluble redox polymerization initiator.

When polymerization is conducted under the foregoing conditions an electrophotographic toner is obtained so that the triboelectrification controlling moieties are on the toner particle surface thereby producing an electrophotographic toner particle having good triboelectrification stability especially in an environment of high temperature and high humidity and thereby being capable of forming a clear image when employed in an electrophotographic process.

The toner particle used according to the present invention is made by processes well known in the art which comprises mixing, kneading and pulverizing a mixture of binder resin, coloring material and optionally a magnetic powder and other additives. In the alternative, the toner particle may be made by other art known processes such as spray drying, suspension polymerization or seed polymerization. The toner particle can also comprise a capsule toner particle having a capsule structure which is also known in the art.

The toner particle can be dispersed in water as is, where it is obtained by a wet process such as suspension polymerization, seed polymerization or interfacial polymerization whereas toner particles obtained by a dry process can be dispersed in water when the toner particles are pre-treated with an appropriate dispersant.

Various dispersants can be used in this process, such as water soluble cellulose derivatives e.g., methyl cellulose, hydroxypropyl methyl cellulose, hydroxyethyl methyl cellulose and carboxymethyl cellulose; water soluble polymers such as polyvinyl alcohol; natural water soluble materials such as gelatin, starch and gum arabic; or interfacial active agents such as alkyl benzene sodium sulfonate, alkyl sulfosuccinic acid salts, polyoxyethylene alkyl ethers, polyoxyethylene sorbitan aliphatic esters, polyoxyethylene aliphatic esters being examples. Of these, water soluble cellulose derivatives and polyvinyl alcohols are preferred.

Polymerization is conducted with the monomer added to the dispersion of toner particles in water and as noted above, the processes conducted either without an emulsifier or where an emulsifier is employed, it is used in a concentration less than the critical micell concentration.

The various monomers that may be employed according to the process of the present invention include by way of example, acrylic acid type monomers such as (meth)acrylic acid; (meth)acrylate esters such as methyl (meth)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate, phenyl (meth)acrylate, trifluoroethyl (meth)acrylate, dimethylaminoethyl (meth)acrylate, diethylaminoethyl (meth)acrylate; or acrylonitrile; aliphatic vinyl esters such as vinyl formate, vinyl acetate, vinyl propionate, vinyl butyrate, vinyl trimethyl acetate, vinyl caproate, vinyl esters of caprylic acid, vinyl sterate; vinyl ethers such as ethyl vinyl ether, propyl vinyl ether, butyl vinyl ether, hexyl vinyl ether, 2-ethylhexyl vinyl ether, phenyl vinyl ether; vinyl ketones such as methyl vinyl ketone, phenyl vinyl ketone; aromatic vinyl compounds such as styrene, chlorostyrene, hydroxystyrene, α-methyl styrene; (meth)acrylic ester type ammonium salt monomers such as acryloyloxyethyl trimethyl ammonium chloride, acryloyloxyethyl triethyl ammonium chloride, methacryloyloxyethyl trimethyl ammonium chloride, methacryloyloxyethyl triethyl ammonium chloride, methacryloyloxyethyl benzyl ammonium chloride; (meth)acrylic amide type ammonium salt monomers such as acrylamide trimethyl propyl ammonium chloride, acrylamide triethyl propyl ammonium chloride, methacrylamide trimethyl propyl ammonium chloride, methacrylamide benzyl propyl ammonium chloride; vinyl benzyl type ammonium salt monomers such as vinyl benzyl ethyl ammonium chloride, vinyl benzyl trimethyl ammonium chloride; vinyl pyridinium salt monomers such as N-butyl vinyl pyridinium bromide, N-cetyl vinyl pyridinium chloride, and vinyl monomers having a quaternary nitrogen such as N-vinyl-2-methyl imidazolinium chloride, N-vinyl-2,3-dimethyl imidazolinium chloride; or polymeric monomers whose halogen ion is replaced by another organic anion. It is possible to use these monomers independently or in admixture of two or more than two of these monomers.

The preferred monomers are the (meth)acrylate esters, ester (meth)acylate type ammonium salt monomers and (meth)acrylamide type ammonium salt monomers.

Water soluble polymerization initiators comprise, peroxides, such as potassium persulfate, ammonium persulfate and hydrogen peroxides; azo compounds such as 4,4'-Azobis(4-cyanovaleric acid) 1,1'-azobis (1-methylbutyronitrile-3-sodium sulfonate); 2,2'-azobis(2-amidinopropane)dihydrochloride; 2,2'-azobisisobutyl amide dihydrate; 2,2'-azobis[2-(2-imidazolin-2-yl)propane]dihydrochloride; and 2,2'-azobis[2-(5-methyl-2-imidazolin-2-yl) propane]dihydrochloride.

Examples of water soluble redox polymerization initiators comprise combinations of a reducing agent and a peroxide, the peroxides comprising persulfate salts, hydrogen peroxide, hydroperoxides and the like. As an example, combinations such as hydrogen peroxide and a ferrous salt may be used as well as a persulfate salt and sodium hydrogen sulfite or cumene hydroperoxide and a ferrous salt as well as a reducing agent in combination with sodium perchlorate.

Capsule manufacturing can be conducted in a manner well known in the art such as described in Japanese unexamined patent publication Nos. Sho 57-179860, 58-66948, 59-148066 and 59-162562.

The resin that may be employed for the capsule outer shell comprises a polyurea resin, polyurethane resin, polyamide resin, polyester resin, epoxy resin, epoxyurea resin, and an epoxyurethane resin.

The polyurea resin or polyurethane resin may be used alone or in combination with one another and similarly, the epoxyurea resin or expoxyurethane resin may be used alone or in combination with one another, the combination of the aforesaid resins being preferred. Depending on the pressure or heat fixing conditions employed when the capsule type toner is used, the thickness of the outer shell of the capsule can be changed or the type or percentage of constituents can be changed in order to change the properties of the capsule when in use.

The core material of the capsule mainly consists of a pressure-fixable component for pressure fixing purposes and a core material mainly consisting of a heat-fixable component is used for heat fixing purposes. More than one component may be used in either respect. Preferred core materials for capsules employed in pressure fixing operations mainly consist of a binder resin, high boiling solvent which dissolves the binder resin, and a colorant or a core material mainly consisting of a soft solid substance and a colorant. Depending on the application, a magnetic powder may be used in place of the colorant, and additives such as silicone oil may be employed for the purpose of improving the fixing properties of the capsule. It is also possible to add high boiling solvents which do not dissolve the binder resin as compared to high boiling solvents which dissolve the binder resin. The colorant incorporated as a component of the core material can be present not only in the core but also the shell interface or the shell of the capsule particle after its formation. The types and the percentage composition of the constituents of the core material can be varied in order to change the properties of the capsule when used in pressure fixing or heat fixing operations.

Any known resins employed for fixing can be used as the binder resin. Specific examples are acrylate polymers such as polymethyl acrylate, polyethyl acrylate, polybutyl acrylate, poly-2-ethylhexyl acrylate, polylauryl acrylate, and methacrylate polymers such as polymethyl methacrylate, polybutyl methacrylate, polyhexyl methacrylate, poly-2-ethylhexyl methacrylate, polylauryl methacrylate, and copolymers of styrene type monomers and acrylics or that of styrene type monomers and methacrylate, and ethylene type polymers and its copolymers such as polyvinyl acetate, polyvinyl propionate, polyvinyl butyrate, polyethylene and polypropylene, and styrene type copolymers such as styrenebutadiene copolymers, styrene isoprene copolymers, styrene maleic acid copolymers, and polyvinyl ether, polyvinyl ketone, polyester, polyamide, polyurethane, rubbers, epoxy resins, polyvinyl butyral, rosins, modified rosins, terpene resins, phenol resins are used independently or in admixture. It is also possible to make binder resins by incorporating the aforesaid binder resins in their monomeric form and polymerizing after encapsulation.

The various high boiling solvents which dissolve the binder resin comprise oily solvents having a boiling point of more than 140° C. and preferably more than 160° C. as for example the Plasticizers described in Modern Plastics Encyclopedia (1975–1976). Core materials for the capsule toners employed for pressure fixing can be chosen from the high boiling solvents described in Japanese unexamined patent publication Nos. Sho 58-145964 or 63-163373. Specific examples in this regard include phthalates such as diethyl pthalate, dibutyl phthalate and aliphatic dicarboxylic esters such as diethyl malonate, dimethyl oxalate and phosphates such as tricresyl phosphate, trixylyl phosphate, and citrates such as o-acetyl triethyl citrate, and benzoates such as butyl benzoate, hexyl benzoate and aliphatic esters such as hexadecyl myristate, dioctyl adipate and alkyl naphthalenes such as methyl naphthalene, dimethyl naphthalene, monoisopropyl naphthalene, diisopropyl napthalene, and alkyl diphenyl ethers such as o-, m-, p-methyl diphenyl ether, and higher aliphatic acids such as N,N-dimethyl lauryl amide, N-butyl benzene sulfonamide or amide compounds of aromatic sulfonic acids, and esters of trimellitic acids such as trioctyl trimellitate, and diarylalkanes such as diarylmethanes, e.g., dimethyl phenyl methane, and diarylethanes such as 1-phenyl-1-methyl phenyl ethane; 1-dimethylphenyl-1-phenylethane; 1-ethylphenyl-1-phenylethane, and chlorinated parrafins. If polymers having long chain alkyl groups such as a lauryl methacrylate homopolymer or copolymer is used in the binder polymer, an organic solvent mainly consisting of aliphatic saturated hydrocarbons, for example, Isopar-G, Isopar-H, Isopar-L available from Exxon Chemical Co. can also be used.

Coloring materials that can be used include inorganic pigments such as carbon black, iron oxide, Prussian blue, titanium oxides and azo pigments such as fast yellow, disazo yellow, pyrazolone red, chelate red, brilliant carmin, parabrown, and phthalocyanine pigments such as copper phthalocyanine, metal-free phthalocyanine, and condensed polycyclic pigments such as flavanthrone yellow, dibromoanthrone orange, perylene red, quinacridone red, and dioxane violet. Disperse dye, oil soluble dye and the like can also be used, and further, as the magnetic 1-component toner, all or part of the black colorant can be replaced by magnetic powders known in the art.

Magnetic powders in this respect include simple metal substances such as magnetite, ferrite, cobalt, iron, nickel or alloys thereof as well as magnetic powders which are surface treated with coupling agents such as silane coupling agents and titanate coupling agents or oil soluble interfacial active agents. Magnetic powders coated with acryl type resins, styrene type resins or epoxy resins can also be used. Furthermore, colorants or magnetic powders incorporated as a component of the core material can be present in the interface between the core and outer shell or in the outer shell. Examples of the soft solid substances include any types available or known in the art provided they have flexibility and fixing properties at room temperature. Preferred soft solid substances include polymers having a glass transition temperature (Tg) from about −60° C. to 5° C. or mixtures thereof or such polymers in combination with other polymers. Two processes are available for incorporating this soft solid substance in the inside of the capsule as a component of the core material. One is to incorporate it beforehand with the other core material component, low boiling solvent and outer shell forming component, then to expel low boiling solvents from the system and to form the core material. The other process is to incorporate the soft solid substance with the monomer combined with the polymerization initiator and at the same time as the formation of the outer shell or after outer shell formation, conducting a polymerization reaction to form the soft solid substance by polymerizing the monomer. Either of the aforementioned processes can be employed.

In addition, external additives may be combined with the toner such as silicon oxide, aluminum oxide, titanium oxide and carbon black to give fluidity or triboelectrification properties to the toner. The process for adding the external additive include processes to adhere it to the toner surface in a so-called dry process using a mixer such as a V-shape blender, Henschel mixer and the like after the capsule toner dries. It is also possible to add the external additive, after dispersing it in a liquid such as water or a water/alcohol combination, to a slurry of capsule toner and after drying to adhere it to the toner surface.

The following examples are illustrative.

EXAMPLE 1

(Preparation of encapsulated particles)

50 g of polylauryl Methacrylate (molecular weight Mw: $5\times10^4$) and 30 g of polyisobutyl methacrylate (molecular weight Mw: $16\times10^4$) were dissolved in a solvent mixture of 10 g of dibutyl phthalate, 40 g of Isopar-H (available from Exxon Chemical Co.) and 40 g of ethyl acetate. 120 g of a magnetic powder (EPT-1000 available from Toda Kogyo K.K.) was then added to the solution. The material was subjected to dispersion in a ball mill for 16 hours. 200 g of the dispersion was then thoroughly mixed with 20 g of isocyanate (Sumidur L available from Sumitomo Bayer Urethane K.K.), 10 g of epoxy resin (EPO-TOHTO yd-8125 available from Tohto Kasei Co., Ltd.) and 24 g of ethyl acetate to prepare Solution A.

On the other hand, 10 g of hydroxypropylmethylcellulose (Metolose 65H50 available from Shin-Etsu Chemical Industry Co., Ltd.) was dissolved in 200 g of deionized water. The solution was cooled to a temperature of 5° C. to prepare Solution B.

Solution A was gradually added to Solution B with stirring in an emulsifier (automatic homomixer available from Tokushuki Kako K.K.) to effect emulsification. Thus an oil-in-water type emulsion comprising oil drops with an average particle diameter of about 12 μm was obtained. The emulsion was stirred at 400 rpm by an agitator (Three-One Motor available from Shinto Kagaku K.K.) equipped with a propeller blade instead of emulsifier. After 10 minutes, 100 g of a 5% aqueous solution of diethylene triamine was added dropwise to the emulsion. After completion of the dropwise addition, the mixture was heated to a temperature of 60° C. where it was then allowed to undergo an encapsulation reaction for 3 hours. After completion of the reaction, the reaction product was then poured into 2 liters of deionized water. The resulting suspension was thoroughly stirred, and then allowed to stand. After the encapsulated particles were precipitated, the supernatant solution was removed from the suspension. This procedure was repeated seven times to wash the encapsulated particles. Thus, encapsulated particles having an oily binder were obtained. Deionized water was added to the encapsulated particles to prepare a suspension with a solid content of 40%.

(Preparation of Toner)

125 g of deionized water was added to 125 g (corresponding to 50 g of encapsulated particles) of the suspension of encapsulated particles thus prepared. The suspension was then stirred at 200 rpm in an agitator equipped with propeller blades (Three-One Motor available from Shinto Kagaku K.K.). 0.4 g of potassium persulfate, 0.5 g of diethylaminoethyl methacrylate and 1.0 g of methyl methacrylate were sequentially added to the resulting emulsion. The emulsion was then allowed to undergo reaction under a nitrogen atmosphere at a temperature of 75° C. for 18 hours. After completion of the reaction, the reaction product was poured into 2 liters of deionized water. The reaction product was thoroughly stirred, and then allowed to stand. After the encapsulated particles were precipitated, the supernatant solution was removed from the reaction system. This procedure was repeated four times to wash the encapsulated particles. The toner of this invention was obtained after pouring the capsule suspension into stainless steel tray and drying it at a temperature of 60° C. in a drier for 10 hours.

3 g of the capsule toner thus obtained was then mixed with 100 g of an iron powder carrier covered with a phenolic resin in an environment of a temperature of 20° C. and a humidity of 50% RH and measured for triboelectrification quantity by the blow-off process. The result was +23 μC/g. Similarly, the capsule toner was mixed with the iron powder carrier in an environment of a temperature of 28° C. and a humidity of 80% RH and measured for triboelectrification quantity by the blow-off process. The result was +21 μC/g.

One part of a hydrophobic silica (RA-200H available from Nippon Aerosil K.K.) was then added to and thoroughly mixed with 100 parts of the toner. The toner was then evaluated for image quality in a high temperature and humidity environment of 35° C. and 85% RH. A Fuji Xerox 2700 copying machine which had been modified for use with capsule toner was used. As a result, 5,000 sheets of stable copies free of fog were obtained. There were few polymer microparticles attached to the donor roll which carries toner to the developing part of the machine.

COMPARATIVE EXAMPLE 1

A capsule toner for comparison was prepared in the same manner as in Example 1 for the encapsulation reaction except that 0.5 g of sodium dioctylsulfosuccinic acid was added. The emulsifier for this reaction was at a concentration higher than the critical micell concentration of 0.05%.

3 g of the capsule toner thus obtained was then mixed with 100 g of an iron powder carrier covered with a phenolic resin in an environment of a temperature of 20° C. and a humidity of 50% RH and measured for triboelectrification quantity by the blow-off process. The result was +10 μC/g. Similarly, the capsule toner was mixed with an iron powder carrier in an environment of a temperature of 28° C. and a humidity of 80% RH and measured for triboelectrification quantity by the blow-off process. The result was +4 μC/g.

Next, 1 part of a hydrophobic silica (RH-200H available from Nippon Aerosil K.K.) was added to and thoroughly mixed with 100 parts of the toner. The toner was then evaluated for image quality in a high temperature and humidity environment of 35° C. and 85% RH as in Example 1. As a result, fog occurred as early as on the first sheet of copy. The 100th sheet of copy exhibited a drop in image concentration and hence an image quality with extremely poor sharpness was obtained.

EXAMPLE 2

(Preparation of encapsulated particles)

60 g of 50-50 copolymer of lauryl methacrylate-styrene and 20 g of petroleum resin (FTR-6125 available from Mitsui Petrochemical Industries, Ltd.) were dissolved in a mixture of 30 g of a saturated hydrocarbon solvent (Isopar-H available from Exxon Chemical Co.) and 30 g of ethyl acetate. 100 g of a magnetic powder which had been subjected to hydrophobic treatment with a titanium coupling agent was then added to the solution. The mixture was subjected to dispersion in a ball mill for 2 hours.

Next, 200 g of the dispersion was mixed with 30 g of isocyanate (Sumidur L available from Sumitomo Bayer Urethane K.K.) and 5 g of toluylene diisocyanate (Coronato T available from Nippon Polyurethane Co., Ltd.) to prepare Solution A.

On the other hand, 10 g of hydroxypropylmethylcellulose (Metolose 65SH50 available from Shin-Etsu Chemical Industry Co., Ltd.) was dissolved in 250 g of deionized water. The solution was cooled to 5° C. to prepare Solution B.

Solution A was gradually added to Solution B with stirring in a emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 2.5% aqueous solution of diethylene triamine was added dropwise to the emulsion. After completion of the dropwise addition, the mixture was heated to 65° C. and then allowed to undergo an encapsulation reaction for 3 hours. After completion of the reaction, the reaction product was then poured into 2 liters of deionized water, which was thoroughly stirred and then allowed to stand. After the encapsulated particles were precipitated, the supernatant solution was removed. The procedure was repeated five times to wash the encapsulated particles to prepare a suspension with a solids content of 40%.

(Preparation of toner)

125 g of deionized water was added to 125 g (corresponding to 50 g of encapsulated particles) of the suspension of encapsulated particles thus prepared. The mixture was then stirred at 200 rpm in an agitator equipped with propeller blades (Three-One Motor available from Shinto Kagaku K.K.). 0.4 g of 2,2'-azobis(2-aminodipropane)dihydrochloride, 0.2 g of methacryloyloxyethyltrimethyl ammonium chloride and 2.0 g of methyl methacrylate were sequentially added to the mixture which was then allowed to undergo reaction under a nitrogen atmosphere at a temperature of 75° C. for 18 hours. After completion of the reaction, the reaction product was poured into 2 liters of deionized water, thoroughly stirred, and then allowed to stand. After the encapsulated particles were precipitated, the supernatant solution was removed from the reaction system. This procedure was repeated four times to wash the encapsulated particles.

Next, 2 g of a 5% aqueous solution of sodium 4-naptholsulfonic acid (available from Wako Junyaku Co., Ltd.) was added to a suspension of encapsulated particles, stirred at room temperature for 30 minutes and then the mixture was allowed to effect an ion exchange reaction. After completion of the reaction, the encapsulated particles were washed with 1 liter of deionized water five times. The capsule suspension thus obtained was then poured into a stainless steel tray. The material was dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50% RH and measured for triboelectrification quantity by the blow-off process. The result was +20 μC/g. Similarly, the capsule toner was mixed with the iron powder carrier in an environment of a temperature of 28° C. and a humidity of 80% RH and measured for triboelectrification quantity by the blow-off process. The result was +18 μC/g.

Next, 1 part of an alumina treated with a titanium coupling agent was added to and thoroughly mixed with 100 parts of toner. The toner was then evaluated for image quality in a high temperature and humidity environment of 35° C. and 85% RH. A Fuji Xerox 2700 copying machine, which had been modified for use with a capsule toner was used. As a result, 2,000 sheets of stable copies free of fog were obtained.

COMPARATIVE EXAMPLE 2

A capsule toner for comparison was prepared in the same manner as in Example 1 for the encapsulation reaction except that 0.5 g of polyoxy ethylene lauryl ether was added. The emulsifier concentration was higher than the critical micell concentration of 0.01%.

3 g of the capsule toner thus obtained was then mixed with 100 g of an iron powder carrier covered with a phenolic resin in an environment of a temperature of 20° C. and a humidity by 50% RH and measured for triboelectrification quantity by the blow-off process. The result was +8 μC/g. Similarly, the capsule toner was mixed with the iron powder carrier in an environment of a temperature of 28° C. and a humidity of 80% RH and measured for triboelectrification quantity by the blow-off process. The result was +4 μC/g.

Next, 1 part of alumina treated with a titanium coupling agent was added to and thoroughly mixed with 100 parts of the toner. The toner was then evaluated for image quality in the same manner as Example 2 in a high temperature and humidity environment of 35° C. and 85% RH. As a result, fog occurred as early as on the first sheet of copy. The 50th sheet of copy exhibited a drop in image concentration and hence an image quality with extremely poor sharpness was obtained.

EXAMPLE 3

(Preparation of encapsulated particles)

50 g of polylauryl methacrylate (molecular weight Mw:$5\times10^4$) and 30 g of polyisobutyl methacrylate (molecular weight Mw:$16\times10^4$) were dissolved in a solvent mixture of 10 g of dibutyl phthalate, 40 g of Isopar-H (available from Exxon Chemical Co.) and 40 g of ethyl acetate. 120 g of magnetic powder (EPT-1000 available from Toda Kogyo K.K.) was then added to the solution. The material was subjected to dispersion in a ball mill for 16 hours. 200 g of the dispersion was then thoroughly mixed with 30 g of isocyanate (Sumidur L available from Sumitomo Bayer Urethane K.K.) and 24 g of ethyl acetate to prepare Solution A.

On the other hand, 10 g of hydroxypropylmethyl cellulose (Metolose 65SH50 available from Shin-Etsu Chemical Industry Co., Ltd.) was dissolved in 200 g of deionized water. The solution was cooled to a temperature of 5° C. to prepare Solution B.

Solution A was gradually added to Solution B with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 5% aqueous solution of diethylene triamine was added dropwise to the emulsion. After completion of the dropwise addition, the mixture was heated to a temperature of 60° C. where it was then allowed to undergo an encapsulation reaction for 3 hours. After completion of the reaction, the reaction product was then poured into 2 liters of deionized water. The resulting suspension was thoroughly stirred, and then allowed to stand. After the encapsulated particles were precipitated, the supernatant solution was removed from the suspension. This procedure was repeated seven times to wash the encapsulated particles. Thus, encapsulated particles containing an oily binder were obtained. Deionized water was added to the encapsulated particles to prepare a suspension with a solid content of 40%.

(Preparation of toner)

125 g of deionized water was added to 125 g (corresponding to 50 g of encapsulated particles) of the suspension of encapsulated particles thus prepared. The mixture was then stirred at 200 rpm in an agitator equipped with propeller blades (Three-One Motor available from Shinto Kagaku K.K.) 0.4 g of potassium persulfate, 0.5 g of diethylaminoethyl methacrylate and 1.0 g of methyl methacrylate, 0.16 g of sodium hydrogensulfite were sequentially added to the mixture which was then allowed to undergo reaction under a nitrogen atmosphere at a temperature of 25° C. for 3 hours. After completion of the reaction, the reaction product was then poured into 2 liters of deionized water, which was thoroughly stirred and then allowed to stand. After the encapsulated particles were precipitated, the supernatant solution was removed. The procedure was repeated four times to wash the encapsulated particles. The capsule suspension thus obtained was then poured into a stainless steel tray. The material was dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50% RH and measured for triboelectrification quantity by blow-off process. The result was +23 μC/g. Simiarly, the capsule toner was mixed with the iron powder carrier in an environment of a temperature of 28° C. and a humidity of 80% RH and measured for triboelectrification quantity by the blow-off process. The result was +21 μC/g.

Next, one part of a hydrophobic silica (RA-200H available from Nippon Aerosil K.K.) was added to and thoroughly mixed with 100 parts of the toner. The toner was then evaluated for image quality in a high temperature and humidity environment of 35° C. and 85% RH. A Fuji Xerox 2700 copying machine, which had been modified for use with a capsule toner was used, and 5,000 sheets of stable copies free of fog were obtained.

COMPARATIVE EXAMPLE 3

A capsule toner for comparison was prepared in the same manner as in Example 3 for an encapsulation reaction except that 0.5 g of sodium dioctyl sulfosuccinic acid was added. The emulsifier for this had a higher concentration than the critical micell concentration of 0.05%.

3 g of the capsule toner thus obtained was then mixed with 100 g of an iron powder carrier covered with a phenolic resin in an environment of a temperature of 20° C. and a humidity of 50% RH and measured for triboelectrification quantity by the blow-off process. The result was +10 μC/g. Similarly, the capsule toner was mixed with the iron powder carrier in an environment of a temperature of 28° C. and a humidity of 80% RH and measured for triboelectrification quantity by the blow-off process. The result was +4 μC/g.

Next, one part of a hydrophobic silica (RH-200H available from Nippon Aerosil K.K.) was added to and thoroughly mixed with 100 parts of the toner. The toner was then evaluated for image quality in a high temperature and humidity environment of 35° C. and 85% RH as in Example 1. As a result, fog occurred as early as on the first sheet of copy. The 100th sheet of copy exhibited a drop in image density and hence an image quality with an extremely poor sharpness was obtained.

EXAMPLE 4

(Preparation of toner particle)

Red polymer particles having an average particle diameter of about 12 μm was obtained after kneading, pulverizing and classifying 1.5 kg of styrene-n-butyl methacrylate copolymer (SANMI-20 available from Sanyo Kasei Co., Ltd.) and 45 g of red pigment (Carmin 6BC available from Sumika Color Co., Ltd.) Then, 50 g of the above described red polymer particles were mixed and dispersed in 300 g of a 2% aqueous solution of methyl cellulose. Next, the red polymer particles were separated by a centrifugal separator and washed with 5 liters of deionized water. Thus, red polymer particles treated with methyl cellulose were obtained.

(Preparation of toner)

500 g of deionized water were added to 50 g of the above prepared red polymer particles and the suspension was then stirred at 200 rpm in an agitator equipped with propeller blades (Three-One Motor available from Shinto Kagaku K.K.). 0.5 g of potassium persulfate, 1.0 g of diethylaminoethyl methacrylate, 2.0 g of methyl methacrylate dissolved in 5 g of methanol and 0.16 g of sodium hydrogen sulfite were sequentially added to the above described red polymer particles. The mixture was then allowed to undergo reaction at a temperature of 25° C. for 3 hours. After completion of the reaction, the reaction product was poured into 2 liters of deionized water. The reaction product was thoroughly stirred, and polymer particles were separated by centrifugal force. This procedure was repeated four times to wash the encapsulated particles.

3 g of the capsule toner thus obtained was then mixed with 100 g of an iron powder carrier covered with a phenolic resin in an environment of a temperature of 20° C. and a humidity of 50% RH and measured for triboelectrification quantity by the blow-off process. The result was +14 μC/g. Similarly, the capsule toner was mixed with the iron powder carrier in an environment of a temperature of 28° C. and a humidity of 80% RH and measured for triboelectrification quantity by the blow-off process. The result was +12 μC/g.

Next, 1 part of a hydrophobic silica (R972 available from Nihon Aerogel K.K.) was added to and thoroughly mixed with 100 parts of the toner. The toner was then evaluated for image quality in a high temperature and humidity environment of 35° C. and 85% RH. A Fuji Xerox 2700 copying machine, which had been modified for use with capsule toners was used, and 2,000 sheets of stable copies free of fog were obtained.

COMPARATIVE EXAMPLE 4

A capsule toner was prepared in the same manner as in Example 3 by an encapsulation reaction except that 0.5 g of polyoxy lauryl ether was added. The emulsifier concentration was higher than the critical micell concentration of 0.01%.

3 g of the capsule toner thus obtained was then mixed with 100 g of an iron powder carrier covered with a phenolic resin in an environment of a temperature of 20° C. and a humidity of 50% RH and measured for triboelectrification quantity by the blow-off process. The result was +8 μC/g. Similarly, the capsule toner was mixed with the iron powder carrier in an environment of a temperature of 28° C. and a humidity of 80% RH and measured for triboelectrification quantity by the blow-off process. The result was +4 μC/g.

Next, 1 part of a hydrophobic silica (R972 available from Nippon Aerosil K.K.) was added to and thoroughly mixed with 100 parts of the toner. The toner was then evaluated for image quality in the same manner as Example 4 in a high temperature and humidity environment of 35° C. and 85% RH. A Fuji Xerox 2700 copying machine, which had been modified for use with capsule toners was used, and as a result, fog occurred as early as on the first sheet of copy. The 50th sheet of copy exhibited a drop in image density and hence an image quality with an extremely poor sharpness was obtained.

EXAMPLE 5

(Preparation of encapsulated particles)

60 g of a 50-50 copolymer of lauryl methacrylate-styrene and 20 g of petroleum resin (FTR-6125 available from Mitsui Petrochemical Industries, Ltd.) were dissolved in a mixture of 30 g of a saturated hydrocarbon solvent (Isopar-H available from Exxon Chemical Co.) and 30 g of ethyl acetate. 100 g of a magnetic powder which had been subjected to hydrophobic treatment with a titanium coupling agent was then added to the solution. The mixture was subjected to dispersion in a ball mill for 2 hours.

Next, 200 g of the above described magnetic powder dispersion was mixed with 30 g of isocyanate (Sumidur L available from Sumitomo Bayer Urethane K.K.) and 5 g of toluylene diisocyanate (Coronate T available from Nippon Polyurethane Co., Ltd.) and 5 g of epoxy resin (Epicote 812 available from Yuka Shell Epoxy Co., Ltd.) to prepare Solution A.

On the other hand, 10 g of hydroxypropylmethylcellulose (Metolose 65SH50 available from Shin-Etsu Chemical Industry Co., Ltd.) was dissolved in 250 g of deionized water. The solution was cooled to 5° C. to prepare Solution B.

Solution A was gradually added into Solution B with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 2.5% aqueous solution of diethylene triamine was added dropwise to the emulsion. After completion of the dropwise addition, the mixture was heated to 65° C. and then allowed to undergo an encapsulation reaction for 3 hours. After completion of the reaction, the reaction product was then poured into 2 liters of deionized water, which was thoroughly stirred and then allowed to stand. After the encapsulated particles were precipitated, the supernatant solution was removed. The procedure was repeated five times to wash the encapsulated particles to prepare a suspension with a solid content of 40%.

(Preparation of toner)

125 g of deionized water was added to 125 g (corresponding to 50 g of encapsulated particles) of the suspension of encapsulated particles thus prepared. The suspension was then stirred at 200 rpm in an agitator equipped with propeller blades (Three-One Motor available from Shinto Kagaku K.K.). 0.4 g of potassium persulfate, 0.2 g of methacryloyloxyethyltrimethyl ammonium chloride, 2.0 g of methyl methacrylate and 0.16 g of sodium hydrogen sulfite were sequentially added to the resulting emulsion. The emulsion was then allowed to undergo reaction at a temperature of 25° C. for 3 hours. After completion of the reaction, the reaction product was poured into 2 liters of deionized water. The reaction product was thoroughly stirred, and then allowed to stand. After the encapsulated particles were precipitated, the supernatant solution was removed from the reaction system. This procedure was repeated four times to wash the encapsulated particles.

Next, 2 g of a 5% aqueous solution of acidic dye (Fast Red A available from Wako Junyaku Co., Ltd.) were added to the suspension of encapsulated particles, and the suspension of encapsulated particles was stirred at room temperature for 30 minutes and then allowed to undergo reaction to become deionized. After completion of the reaction, the encapsulated particles were washed with 1 liter of deionized water five times. The capsule toner of this invention was obtained after pouring the capsule suspension into a stainless steel tray and drying at a temperature of 60° C. in a drier (available from Yamato Kagaku K.K.) for 10 hours.

3 g of the capsule toner thus obtained was then mixed with 100 g of an iron powder carrier covered with a phenolic resin in an environment of a temperature of 20°

C. and a humidity of 50% RH and measured for triboelectrification quantity by the blow-off process. The result was +20 μC/g. Similarly, the capsule toner was mixed with the iron powder carrier in an environment of a temperature of 28° C. and a humidity of 80% RH and measured for triboelectrification quantity by the blow-off process. The result was +18 μC/g.

Next, one part of an alumina treated with a titanium coupling agent (KR-TTS available from Ajinomoto Co., Ltd.) was added to and thoroughly mixed with 100 parts of toner. The toner was then evaluated for image quality in a high temperature and humidity environment of 35° C. and 85% RH. A Fuji Xerox 2700 copying machine, which had been modified for use with capsule toners was used. As a result, 2,000 sheets of stable copies free of fog were obtained.

COMPARATIVE EXAMPLE 5

A capsule toner for comparison was prepared in the same manner as in Example 3 for an encapsulation reaction except that 0.5 g of polyoxy lauryl ether was added. The emulsifier for this had a concentration higher than critical micell concentration of 0.01%. After the suspension of encapsulated particles is treated in the same way as Example 3 without adding an acidic dye (Fast Red A available from Wako Junyaku Co., Ltd.) to this suspension of encapsulated toner, a capsule toner for comparison was obtained.

3 g of the capsule toner thus obtained was then mixed with 100 g of an iron powder carrier coated with a phenolic resin and placed in an environment of a temperature of 20° C. and a humidity of 50% RH and measured for triboelectrification quantity by the blow-off process. The result was +8 μC/g. Similarly, the capsule toner was mixed with the iron powder carrier at a temperature of 28° C. and a humidity of 80% RH and measured for triboelectrification quantity by the blow-off process. The result was +4 μC/g.

Next, 1 part of an alumina treated with a titanium coupling agent (KR-TTS available from Ajinomoto Co., Ltd.) was added to and thoroughly mixed with 100 parts of the toner. The toner was then evaluated for image quality in the same was as Example 4 in a high temperature and humidity environment of 35° C. and 85% RH. As a result, fog occurred as early as on the first sheet of copy. The 50th sheet of copy exhibited a drop in image density and hence an image quality with extremely poor sharpness was obtained.

COMPARATIVE EXAMPLE 6

125 g of deionized water, 0.5 g of diethylaminoethyl methacrylate, 1.0 g of methyl methacrylate and 0.12 g of sodium dodecyl benzene sulfonic acid were added to a three neck flask equipped with a nitrogen introducing tube, condenser tube and agitator, and after the mixture was heated to 75° C., 0.4 g of potassium persulfate was added to the mixture and the mixture was allowed to undergo emulsion polymerization under a nitrogen atmosphere at 75° C. for 18 hours. Then, 50 g of encapsulated particles obtained in Example 3 was added to the thus obtained latex aqueous solution followed by mixing intensively at room temperature. 50 g of a 10% aqueous magnesium sulfate solution was gradually added to the solution. A capsule toner of Comparative Example 6 was obtained after filtering, rinsing and air-drying the solution. 3 g of the capsule toner thus obtained was then mixed with 100 g of an iron powder carrier coated with a phenolic resin in an environment of a temperature of 20° C. and a humidity of 50% RH and measured for triboelectrification quantity by the blow-off process. The result was +10 μC/g. Similarly, the capsule toner was mixed with the iron powder carrier in an environment of a temperature of 28° C. and a humidity of 80% RH and measured for triboelectrification quantity by the blow-off process. The result was +5 μC/g.

Next, 1 part of a hydrophobic silica (R972 available from Nippon Aerosil K.K.) was added to and thoroughly mixed with 100 parts of the toner. The toner was then evaluated for image quality in the same manner as Example 3 in a high temperature and high humidity environment of 35° C. and 85% RH, and fog occurred as early as on the first sheet of copy. The 100th sheet of copy exhibited a drop in image density and hence an image quality with an extremely poor sharpness was obtained. There were also many emulsion polymerized particles attached to the donor roll, which caries toner to the developing part, this attachment causing a decline in the quantity of toner that was carried.

The foregoing description of preferred embodiments for the invention have been presented for purposes of illustration and description. It is not intended to be exhaustive or to limit the invention to the precise form disclosed, and modifications and variations are possible in light of the above teachings or may be acquired from practice of the invention. The embodiment(s) was (were) chosen and described in order to describe the principles of the invention and its practical application to enable one skilled in the art to utilize the invention in various embodiments and with various modifications as are suited to the particular use contemplated. It is intended that the scope of the invention be defined by the claims appended hereto, and their equivalents.

We claim:

1. A process for manufacturing an electrophotographic toner comprising the steps of:
   - preparing a dispersion containing water and toner particles having a resin and a colorant dispersed in said water;
   - adding a monomer to said dispersion to obtain a mixture of said monomer and said dispersion;
   - polymerizing said mixture without an emulsifying agent or an emulsifying agent present in an amount less than the critical micell concentration.

2. The process of claim 1 wherein said monomer is a (meth)acrylate ester, aliphatic vinyl ester, aromatic vinyl compound, (meth)acrylic ester type ammonium salt, (meth)acrylic amide, vinyl benzyl ammonium salt, vinyl pyridinium salt, or a vinyl monomer having a quaternary nitrogen.

3. The process of claim 1 wherein said monomer is a (meth)acrylic acid.

4. The process of claim 2 wherein said monomer is a (meth)acrylate ester.

5. The process of claim 2 wherein said monomer is a (meth)acrylic ester type ammonium salt.

6. The process of claim 2 wherein said monomer is a (meth)acrylic amide.

7. The process of claim 2 wherein said polymerization is conducted in the presence of a water soluble redox catalyst.

8. The process of claim 2 wherein said toner particle is formed by a dry process comprising mixing, kneading or pulverizing a polymer, said polymer optionally being in combination with a magnetic powder or a coloring material.

9. The process of claim 2 wherein said toner particle is formed by a wet process comprising spray drying a polymer solution, forming a polymer by suspension polymerization or forming a polymer by seed polymerization, said polymer optionally being in combination with a magnetic power or coloring material.

10. The process of claim 2 wherein said toner is a capsule.

11. The process of claim 10 wherein said toner particle is a capsule which can be fixed by pressure.

12. The process of claim 10 wherein said toner particle is a capsule which can be fixed by heat and pressure.

13. The process of claim 2 wherein the emulsifying agent when employed is a water soluble cellulose derivative, a polyvinyl alcohol, gelatin, starch, gum arabic or an interfacial active agent.

14. The process of claim 13 wherein said emulsifying agent when employed is a water soluble cellulose derivative.

15. The process of claim 13 wherein said emulsifying agent when employed is a polyvinyl alcohol.

16. The process of claim 13 wherein said emulsifying agent when employed is an interfacial active agent.

17. The product produced by the process of claim 1.

18. The product produced by the process of claim 2.

19. The product produced by the process of claim 8.

20. The product produced by the process of claim 10.

* * * * *